US011988205B2

(12) United States Patent
Finsterle et al.

(10) Patent No.: US 11,988,205 B2
(45) Date of Patent: May 21, 2024

(54) PUMP-MOTOR UNIT COMPRISING AN INTEGRATIVE HOUSING COVER

(71) Applicant: Schwäbische Hüttenwerke Automotive GmbH, Aalen-Wasseralfingen (DE)

(72) Inventors: Thomas Finsterle, Ravensburg (DE); Holger Braasch, Pfullendorf (DE)

(73) Assignee: Schwäbische Hüttenwerke Automotive GmbH, Aalen-Wasseralfingen (DE)

( * ) Notice: Subject to any disclaimer, the term of this patent is extended or adjusted under 35 U.S.C. 154(b) by 42 days.

(21) Appl. No.: 17/458,814

(22) Filed: Aug. 27, 2021

(65) Prior Publication Data

US 2022/0065249 A1 Mar. 3, 2022

(30) Foreign Application Priority Data

Sep. 1, 2020 (DE) ..... 10 2020 122 867.8

(51) Int. Cl.
*F04C 15/00* (2006.01)
*F01C 21/10* (2006.01)
(Continued)

(52) U.S. Cl.
CPC ..... *F04C 15/0096* (2013.01); *F01C 21/10* (2013.01); *F04C 2/10* (2013.01);
(Continued)

(58) Field of Classification Search
CPC .... F04C 15/0096; F04C 2/10; F04C 15/0034; F04C 2240/30; F04C 2240/40; F04C 11/008; F01C 21/10
See application file for complete search history.

(56) References Cited

U.S. PATENT DOCUMENTS 7,367,787 B2 * 5/2008 Arbogast ..... F04C 11/008 417/423.1
8,840,385 B2 * 9/2014 Lipinski ..... F04C 11/008 418/152
(Continued)

FOREIGN PATENT DOCUMENTS

CN 205977712 U 2/2017
DE 102015211759 A1 1/2016
(Continued)

OTHER PUBLICATIONS

Extended European Search Report for European Application No. 21 191 164.9, dated Jan. 27, 2022, with translation, 11 pages.
(Continued)

*Primary Examiner* — Mary Davis
(74) *Attorney, Agent, or Firm* — BUCHANAN INGERSOLL & ROONEY PC

(57) ABSTRACT

A pump-motor unit for delivering a fluid, for example gear oil and/or lubricating oil in motor vehicles, includes: a housing having a housing cover, an intermediate housing structure and a motor cover, wherein the housing cover and the intermediate housing structure define a delivery chamber axially on both end-facing sides and circumferentially in the radial direction; a delivery device featuring a delivery member, which can be rotated within the delivery chamber, for delivering the fluid; and a drive motor which is connected to the delivery device via a drive shaft, wherein the housing cover forms an accommodating well, and the drive motor and the intermediate housing structure are arranged in the accommodating well.

25 Claims, 3 Drawing Sheets

(51) Int. Cl.
*F04C 2/10* (2006.01)
*F04C 11/00* (2006.01)

(52) U.S. Cl.
CPC ..... *F04C 11/008* (2013.01); *F04C 15/0034* (2013.01); *F04C 2240/30* (2013.01); *F04C 2240/40* (2013.01)

(56) References Cited

U.S. PATENT DOCUMENTS

| | | | | |
|---|---|---|---|---|
| 9,695,691 | B2 * | 7/2017 | Shimaguchi | F01C 21/10 |
| 9,810,223 | B2 * | 11/2017 | Irie | F04C 11/008 |
| 9,850,901 | B2 * | 12/2017 | Ignatiev | F01C 21/10 |
| 10,563,654 | B2 | 2/2020 | Ott et al. | |
| 2015/0147216 | A1 | 5/2015 | Shimaguchi et al. | |
| 2016/0010646 | A1 | 1/2016 | Hess et al. | |
| 2017/0321794 | A1 * | 11/2017 | Kiehlneker | F04C 11/008 |
| 2020/0182241 | A1 | 6/2020 | Pawellek et al. | |
| 2021/0040949 | A1 | 2/2021 | Nickel et al. | |
| 2021/0156380 | A1 * | 5/2021 | Kataoka | H02K 7/14 |

FOREIGN PATENT DOCUMENTS

| | | | | |
|---|---|---|---|---|
| DE | 102016121240 | A1 | 5/2018 | |
| DE | 102018105732 | A1 | 9/2019 | |
| DE | 102018124220 | A1 | 10/2019 | |
| EP | 1368880 | B1 * | 12/2013 | F04B 1/0443 |
| JP | 2014058961 | A | 4/2014 | |
| WO | WO-2019044515 | A1 * | 3/2019 | F04C 15/008 |

OTHER PUBLICATIONS

German Search Report issued in German Patent Application No. 10 2020 122 867.8 dated May 4, 2021, 7 pages. Partial translation.
Chinese Office Action for Chinese Application No. 202111009940.3, dated Jun. 9, 2023 with translation, 16 pages.

* cited by examiner

PUMP-MOTOR UNIT COMPRISING AN INTEGRATIVE HOUSING COVER

CROSS REFERENCE TO RELATED APPLICATION

This application claims benefit of priority from German Patent Application 10 2020 122 867.8, filed Sep. 1, 2020. The contents of this application are incorporated herein by reference.

BACKGROUND OF THE INVENTION

Pump-motor units for delivering a fluid, for example gear oil and/or lubricating oil in motor vehicles, are known from the prior art. Such pump-motor units comprise a pump which is driven by a drive motor, wherein the drive motor and the pump are usually arranged in a common housing. The prior-art pump-motor units are generally fitted in a fitting well of the consumer, for example the gearbox, and are therefore also referred to as well pumps. In order to protect the prior-art pump-motor units from external environmental influences and leakage, the fitting structure is generally embodied as a fitting flange, wherein the fitting well is sealed off by means of a gasket between the fitting flange and the end-facing enclosure of the fitting well. In such designs, the fitting well usually serves as a low-pressure space which is filled with the fluid to be delivered and is connected in fluid communication with the suction port of the fluid pump.

The housing of the prior-art pump-motor units is generally structured modularly, wherein the pump housing is connected to the motor housing and to the electronics housing, wherein the pump-motor unit is substantially protected from external environmental influences, such as for example dirt, by the fitting well and the fitting structure. In wet-running electric motors in particular, it is often then possible to omit an elaborate and cost-intensive seal on the motor housing, since the fitting well which surrounds the pump-motor unit performs the function of protecting and sealing off from the environment. This in particular requires the fitting well and the fitting structure to be produced precisely and in particular requires a cost-intensive surface treatment of the surfaces which are in contact with each other. Such embodiments as a well pump also have the disadvantage that the housing of the consumer, for example the gearbox, must provide a fitting well. This results in a larger space requirement and generally heavier consumer housings. It also generally increases the development costs for the manufacturer of the consumer and pump-motor unit.

Exterior pump-motor units are known from the prior art which do not need to be accommodated in a motor well of the consumer but can for example be fastened to the outside of the consumer. Such exterior pump-motor units often comprise a multi-part housing which performs the function of the fitting well and protects the individual components within the housing from external environmental influences. Housings are also often used which substantially imitate a fitting well and surround the pump-motor unit, which is formed in the same way as a well pump. Multi-part housings in particular have to be sealed off in a cost-intensive way in order to protect the pump-motor unit from external environmental influences, or the number of components is increased by an additional surrounding housing, which in particular results in heavier and above all space-intensive pump-motor units.

SUMMARY OF THE INVENTION

It is therefore an aspect of the invention to provide an exterior pump-motor unit which does not need to be accommodated in a fitting well of the consumer and which can be manufactured in a cost-effective and space-saving way.

A pump-motor unit such as an aspect of the invention relates to can in particular be designed for use in a motor vehicle. The pump-motor unit can correspondingly be formed as a motor vehicle pump. The pump-motor unit preferably serves to deliver a liquid, in particular a lubricant, coolant and/or actuating agent. The pump-motor unit can be formed as a liquid pump. The pump-motor unit is preferably designed to supply, lubricate and/or cool a motor vehicle drive, in particular a motor vehicle engine, or a vehicle gearbox such as for example an automatic gearbox. The liquid is preferably formed by an oil, in particular an engine lubricating oil or gear oil. The pump-motor unit is preferably formed as an engine lubricant pump for a motor vehicle or as a gear pump for a motor vehicle.

The pump-motor unit for delivering a fluid, such as an aspect of the invention relates to, comprises a housing featuring a housing cover, an intermediate housing structure and a motor cover, wherein the housing cover and the intermediate housing structure define a delivery chamber axially on both end-facing sides and circumferentially in the radial direction. The pump-motor unit also comprises: a delivery device featuring a delivery member, which can be rotated within the delivery chamber, for delivering the fluid; and a drive motor which is connected to the delivery device via a drive shaft. Preferably, the pump-motor unit additionally comprises an electronics cover.

The pump-motor unit can comprise a fitting structure by means of which the pump-motor unit can be connected to a consumer, for example a gearbox. The fitting structure protrudes, preferably on the radially outer side, from the housing cover. For fastening the pump-motor unit, the fitting structure can comprise passages through which fastening elements, for example screws, can protrude in order to form a holding engagement with bores or cavities provided on the consumer.

The housing of the pump-motor unit can be held together by means of at least one holding element. The holding element can for example be formed by a screw or a pin, in particular a press-fit pin. The at least one holding element can protrude from and/or through the housing cover and/or the electronics cover. The holding element preferably protrudes from the electronics cover and through the housing cover. The motor cover is preferably held axially between the housing cover and the electronics cover, wherein the holding element can protrude through the motor cover, or the motor cover can be tensed axially between the housing cover and the electronics cover.

Preferably, the intermediate housing structure defines the delivery chamber axially on a first end-facing side and over its circumference. The housing cover can define the delivery chamber axially on a second end-facing side. In alternative embodiments, the intermediate housing structure can define the delivery chamber axially on one end-facing side only, while the housing cover defines the delivery chamber axially on an end-facing side and circumferentially. The end-facing side of the intermediate housing structure which axially faces the housing cover, and an end-facing side of the housing cover which axially faces the intermediate housing structure, are preferably in direct contact. Preferably, no other component is formed between the housing cover and the intermediate housing structure in the axial direction.

The intermediate housing structure preferably comprises a cavity in the end-facing side which faces the housing cover, wherein the base of said cavity defines the delivery chamber on the end-facing side which faces away from the housing cover, and the circumferential wall of said cavity circumferentially encloses the delivery chamber. In such embodiments, the housing cover preferably seals off the delivery chamber on the end-facing side which faces axially away from the motor cover. In alternative embodiments, the housing cover can comprise a cavity in the end-facing side which faces the intermediate housing structure, wherein the base of said cavity defines the delivery chamber on the end-facing side which faces away from the intermediate housing structure, and the circumferential wall of said cavity circumferentially encloses the delivery chamber. In this case, the intermediate housing structure preferably seals off the delivery chamber on the end-facing side which axially faces the motor cover.

A rotatable delivery member for delivering the fluid is formed in the delivery chamber. The delivery member is preferably rotary-driven via the drive shaft. The delivery member is preferably connected non-rotationally to the drive shaft. The delivery member can also be connected to the drive shaft such that it is fixed against shifting in the axial direction. Preferably, however, the delivery member can be freely moved in the axial direction. In this way, production inaccuracies and tolerances can be taken into account.

A positive-fit, frictional-fit or material-fit connection can prevail between the delivery member and the drive shaft. A positive-fit connection can for example be formed by a spline shaft profile, a serration or by additional elements such as for example a press-fit spring, a sliding spring or a cross pin. In a frictional-fit connection, the delivery member can for example be clamped or press-fitted on the drive shaft. A material-fit connection between the drive shaft and the delivery member can for example be established by gluing, soldering or welding.

The delivery member is preferably formed by an externally toothed internal gear. In preferred embodiments, the delivery device comprises at least a second delivery member, wherein the second delivery member is preferably an internally toothed external gear. The delivery member is preferably surrounded on the radially outer side by the second delivery member. The rotational axis of the delivery member and the rotational axis of the second delivery member preferably extend parallel to each other at a distance. The second delivery member can thus be formed eccentrically with respect to the first delivery member.

The delivery member and the second delivery member, in particular the teeth of the externally toothed delivery member and the teeth of the internally toothed second delivery member, are preferably in engagement with each other, such that a rotation of the delivery member can be transmitted onto the second delivery member. Delivery cells can be formed between the engaging teeth, which change their volume as the delivery member and the second delivery member rotate, such that fluid can be delivered from a low-pressure side of the pump to a high-pressure side of the pump. Internal gear pumps of this type are known to the person skilled in the art, for which reason a detailed description shall be omitted here. An aspect of the invention is not intended to be limited to internal gear pumps, and vane cell pumps or external gear pumps can for example also be used.

In preferred embodiments, the drive shaft protrudes through the delivery member in the axial direction. The drive shaft particularly preferably protrudes through the delivery member in the axial direction far enough that the drive shaft protrudes beyond the delivery member on both sides in the axial direction. The drive shaft can protrude through the housing cover and/or the intermediate housing structure. Preferably, the drive shaft protrudes through the intermediate housing structure and into a cavity in the housing cover, without protruding through it. In this way, the drive shaft can be mounted by the housing cover and/or the intermediate housing structure. In preferred embodiments, the drive shaft is mounted by the housing cover and the intermediate housing structure on both sides of the delivery member in the axial direction.

The housing cover and/or the intermediate housing structure can form a slide bearing for the drive shaft. In preferred embodiments, the housing cover and/or the intermediate housing structure forms or each form a hydrostatic slide bearing for the drive shaft. To this end, the slide bearing of the housing cover and/or intermediate housing structure is connected in fluid communication with the delivery chamber and in particular with the high-pressure side of the delivery chamber.

The slide bearing of the housing cover and/or intermediate housing structure can comprise a radial gap to which fluid from the delivery chamber can be applied. The radial gap can be formed circumferentially around a rotational axis of the drive shaft or can be formed exclusively in a region of the slide bearing. The radial gap can for example be formed as a longitudinal groove which extends in the axial direction of the slide bearing.

The housing cover comprises an accommodating well featuring a housing cover circumferential wall which axially overlaps with a circumferential wall of the intermediate housing structure. The drive motor and the intermediate housing structure are arranged in the accommodating well of the housing cover. The intermediate housing structure is preferably arranged between the housing cover and the drive motor in the axial direction. The intermediate housing structure is preferably enclosed on the radially outer side by the accommodating well of the housing cover.

The intermediate housing structure is preferably supported in the radial direction, preferably over 360°, on the housing cover circumferential wall. To this end, the circumferential wall of the intermediate housing structure is preferably in contact with the housing cover circumferential wall over its entire circumference in a first region. This first region preferably extends in the axial direction at least as far as the axial extent of the delivery chamber. In a second region, an annular gap can be formed between the circumferential wall of the intermediate housing structure and the housing cover circumferential wall.

In the axial direction, the intermediate housing structure is preferably also supported in the accommodating well of the housing cover on the end-facing side which faces axially away from the motor cover. The end-facing side of the intermediate housing structure which axially faces the housing cover is preferably in contact with the base of the accommodating well of the housing cover which axially faces the intermediate housing structure.

The housing cover preferably forms a pressure port and a suction port for delivering fluid. The pressure port and the suction port can be formed on the end-facing side of the housing cover which faces axially away from the intermediate housing structure. The pressure port and the suction port are preferably connected in fluid communication with the delivery chamber. In alternative embodiments, the pressure port and the suction port can also be formed on the radially outer side by the housing cover.

The pressure port and the suction port are in particular connected in fluid communication with the delivery chamber via a delivery chamber inlet and a delivery chamber outlet. The delivery chamber inlet and the delivery chamber outlet are preferably also formed by the housing cover. The delivery chamber inlet and the delivery chamber outlet are preferably formed on the end-facing side of the housing cover which axially faces the intermediate housing structure.

At least the pressure port can be surrounded by a gasket, in particular a radial gasket. Preferably, each of the suction port and the pressure port is surrounded radially by a gasket. In preferred embodiments, the gasket of the suction port surrounds both the suction port and the pressure port. The gasket of the pressure port and the gasket of the suction port can be formed as a common gasket or as individual gaskets. In particularly preferred embodiments, the gasket of the suction port serves to seal off the pressure port and the suction port from the environment, while the gasket of the pressure port serves to seal off the pressure port from the suction port.

The housing cover is preferably integrally formed. Within the meaning of an aspect of the invention, "integrally" means that a component, in particular the housing cover, cannot be separated into two separate parts without being destroyed. Parts which are joined to each other, above all in a positive fit and/or force fit, in particular parts which are screwed to each other, do not therefore constitute an integral component within the meaning of an aspect of the invention. In preferred embodiments, the housing cover is molded in an original-molding method or a reshaping method or consists of parts which are joined in a material fit. The housing cover can for example be manufactured by means of casting, deep drawing or sintering. In preferred embodiments, the housing cover is a metal-cast component.

In preferred embodiments, the intermediate housing structure is also formed integrally. The intermediate housing structure is preferably molded in an original-molding method or a reshaping method or consists of parts which are joined in a material fit. The intermediate housing structure can for example be manufactured by means of casting, deep drawing or sintering. In preferred embodiments, the intermediate housing structure is a metal-cast component. The intermediate housing structure and the housing cover are preferably components which are formed separately from each other.

The housing cover and/or the intermediate housing structure are preferably manufactured from metal, but can for example also be manufactured from plastic.

A recess groove which encircles a rotational axis of the drive shaft can be formed between the intermediate housing structure and the housing cover. The recess groove can be formed in the end-facing side of the intermediate housing structure which axially faces the housing cover and/or in the end-facing side of the housing cover which axially faces the intermediate housing structure. The radial extent of the recess groove in the intermediate housing structure and/or the housing cover is preferably identical in size throughout in the circumferential direction.

If the recess groove is formed in the intermediate housing structure and the housing cover, then the recess groove formed in the intermediate housing structure overlaps, preferably completely, in the radial direction with the recess groove formed in the housing cover. In alternative embodiments, it is possible for the recess groove formed in the intermediate housing structure to not overlap or to partially overlap radially with the recess groove formed in the housing cover.

The recess groove in the intermediate housing structure can also exhibit a different radial extent to the recess groove in the housing cover, wherein "radial extent" is understood to mean the width of the recess groove in the radial direction. Preferably, the recess groove in the intermediate housing structure exhibits the same radial extent as the recess groove in the housing cover.

The recess groove in the housing cover and/or intermediate housing structure is preferably connected in fluid communication with the suction port of the pump-motor unit. In preferred embodiments, the recess groove in the housing cover and/or intermediate housing structure overlaps in the radial direction with the suction port. In addition to reducing weight, the recess groove can in particular serve to reduce cost when machining the end-facing side of the intermediate housing structure which axially faces the housing cover and the end-facing side of the housing cover which axially faces the intermediate housing structure.

The drive motor is preferably arranged in the accommodating well between the motor cover and the intermediate housing structure in the axial direction. The drive motor can be an electric motor comprising a rotor and a stator, for example an electric internal-rotor motor. Preferably, the rotor is non-rotationally connected to the drive shaft, preferably such that it is fixed against shifting in the axial direction. The stator preferably comprises coils through which a current can be passed, thus enabling magnetic fields to be induced. The rotor preferably comprises permanent magnets which can be attracted and/or repelled by the magnetic fields of the stator coils, whereby the rotor and therefore the drive shaft is rotary-driven.

The stator of the drive motor can be held axially by the intermediate housing structure and the motor cover. In preferred embodiments, the stator is supported in the axial direction on the intermediate housing structure and the motor cover. A radial gap is preferably formed between the stator of the drive motor, in particular an outer circumferential wall of the stator, and the housing cover, in particular the housing cover circumferential wall. The radial gap preferably surrounds the stator by more than 180° and particularly preferably over 360°.

The drive motor is preferably arranged between the intermediate housing structure and the motor cover in the axial direction. The motor cover preferably seals off the accommodating well of the housing cover, preferably in a fluid-proof seal, on the side which faces axially away from the delivery chamber. The motor cover is preferably manufactured from plastic.

The housing cover comprises a housing cover circumferential wall, and the motor cover comprises a motor cover circumferential wall, wherein the housing cover circumferential wall and the motor cover circumferential wall can axially overlap each other. A gasket, preferably a radial gasket, is preferably formed between the motor cover and the housing cover, in particular between the housing cover circumferential wall and the motor cover circumferential wall. The motor cover can protrude in the axial direction at least partially into the accommodating well of the housing cover.

The drive motor is preferably a wet-running electric motor. To this end, the accommodating well of the housing cover is preferably connected in fluid communication with the delivery chamber, in particular with the high-pressure side of the delivery chamber, in the region of the drive motor. The accommodating well can be connected in fluid communication with the delivery chamber via a leakage in the region of the drive motor. The leakage can be formed via a radial gap between the drive shaft and the intermediate housing structure.

The accommodating well of the housing cover is preferably connected to the delivery chamber via the slide bearing of the intermediate housing structure. Fluid can preferably flow from the delivery chamber in the axial direction through the intermediate housing structure, past the drive shaft and into the accommodating well of the housing cover in the region of the drive motor.

The accommodating well can be connected in fluid communication with the suction port of the pump-motor unit in the region of the drive motor. In this way, fluid can flow off from the accommodating well in the region of the drive motor. In this way, fluid can continuously flow around the drive motor, and the drive motor can be continuously cooled, during operation. The accommodating well is preferably also connected in fluid communication with the delivery chamber inlet in the region of the drive motor. In this way, the delivery chamber can be pre-loaded when the accommodating well is connected to the high-pressure side of the delivery chamber in the region of the drive motor. This means that fluid which is suctioned by the rotation of the delivery member preferably exhibits a higher initial pressure.

The accommodating well is preferably connected in fluid communication with the suction port of the pump-motor unit via a connecting channel in the region of the drive motor. The connecting channel can be formed as a passage through the intermediate housing structure. In alternative embodiments, the connecting channel can for example be formed by a cavity on the radially outer circumference of the intermediate housing structure or by a channel in the housing cover. If a recess groove is formed between the intermediate housing structure and the housing cover, then the connecting channel preferably overlaps with the recess groove in the radial direction.

The pump-motor unit preferably comprises an electronics cover which is arranged on the end-facing side on the side of the motor cover which faces axially away from the drive motor. The motor cover and the electronics cover preferably form an electronics space which is defined in the axial direction by the electronics cover and/or the motor cover. The electronics space is preferably defined axially on both end-facing sides and circumferentially in the radial direction by the electronics cover and the motor cover.

The electronics cover preferably defines the electronics space axially on one end-facing side and circumferentially, and the motor cover preferably defines the electronics space axially on one end-facing side. The motor cover preferably seals off the electronics space, preferably in a fluid-proof seal, on the side which axially faces the drive motor.

The electronics cover can comprise an electronics cover circumferential wall which overlaps with the motor cover circumferential wall in the axial direction. The electronics cover circumferential wall preferably encloses the motor cover circumferential wall on the radially outer side. A gasket is preferably formed between the motor cover and the electronics cover, in particular between the motor cover circumferential wall and the electronics cover circumferential wall. The gasket is preferably formed as a radial gasket. The motor cover can protrude axially into a cavity in the electronics cover.

Control electronics are preferably formed in the electronics space. The control electronics are preferably formed between the motor cover and the electronics cover in the axial direction. The control electronics can for example control the drive motor. The control electronics are preferably surrounded on the radially outer side by the electronics cover. The rear side of the control electronics, which lies axially opposite the electronics cover, is preferably connected to the electronics cover in a thermally conductive way. The control electronics are preferably connected to the electronics cover in a thermally conductive way by means of a thermally conductive paste.

The electronics cover can comprise cooling elements, in particular cooling fins, for cooling the pump-motor unit and in particular for cooling the control electronics of the pump-motor unit, on the end-facing side which faces axially away from the drive motor. The cooling fins are preferably formed from metal.

The electronics cover and the cooling elements can be integrally formed together. The electronics cover and the cooling elements are preferably molded in an original-molding method or a reshaping method or consist of parts which are joined in a material fit. In alternative embodiments, the cooling elements are joined to the electronics cover in a subsequent manufacturing step. The electronics cover can then for example be cast around the cooling elements, or the cooling elements can be glued, welded or soldered to the electronics cover. In this way, the cooling elements could comprise a different material to the electronics cover. Preferably, the electronics cover and the cooling fins are formed from the same material.

Features of an aspect of the invention are also described in the aspects formulated below. The aspects are worded in the manner of claims and can substitute for them. Features disclosed in the aspects can also supplement and/or qualify the claims, indicate alternatives with respect to individual features and/or broaden claim features. Bracketed reference signs refer to example embodiments of the invention illustrated below in figures. They do not restrict the features described in the aspects to their literal sense as such, but do conversely indicate preferred ways of implementing the respective feature.

Aspect 1. A pump-motor unit for delivering a fluid, for example gear oil and/or lubricating oil in motor vehicles, comprising:

1.1 a housing comprising a housing cover (1), an intermediate housing structure (12) and a motor cover (2), wherein the housing cover (1) and the intermediate housing structure (12) define a delivery chamber axially on both end-facing sides and circumferentially in the radial direction;

1.2 a delivery device (10) featuring a delivery member (13, 14), which can be rotated within the delivery chamber, for delivering the fluid;

1.3 and a drive motor (20) which is connected to the delivery device (10) via a drive shaft (4), characterized in that 1.4 the housing cover (1) forms an accommodating well (11), and 1.5 the drive motor (20) and the intermediate housing structure (12) are arranged in the accommodating well (11).

Aspect 2. The pump-motor unit according to the preceding aspect, characterized in that the intermediate housing structure (12) defines the delivery chamber axially on an end-facing side and circumferentially, and the housing cover (1) defines the delivery chamber axially on an end-facing side.

Aspect 3. The pump-motor unit according to any one of the preceding aspects, characterized in that the housing cover (1) seals off the delivery chamber on the end-facing side on the side which faces axially away from the motor cover (2).

Aspect 4. The pump-motor unit according to any one of the preceding aspects, characterized in that the housing cover (1) comprises a housing cover circumferential wall, and the intermediate housing structure (12) comprises an intermediate housing structure circumferential wall, wherein the housing cover circumferential wall and the intermediate housing structure circumferential wall axially overlap.

Aspect 5. The pump-motor unit according to any one of the preceding aspects, characterized in that the accommodating well (11) encloses the intermediate housing structure (12) on the radially outer side.

Aspect 6. The pump-motor unit according to any one of the preceding aspects, characterized in that the intermediate housing structure (12) is supported radially and/or axially in the accommodating well (11) of the housing cover (1).

Aspect 7. The pump-motor unit according to any one of the preceding aspects, characterized in that the housing cover (1) forms a pressure port (5) and a suction port (6).

Aspect 8. The pump-motor unit according to any one of the preceding aspects, characterized in that the housing cover (1) forms a pressure port (5) and a suction port (6) and in that the pressure port (5) and the suction port (6) are formed in the end-facing side of the housing cover (1) which faces axially away from the delivery chamber.

Aspect 9. The pump-motor unit according to any one of the preceding aspects, characterized in that the housing cover (1) forms a delivery chamber inlet and a delivery chamber outlet.

Aspect 10. The pump-motor unit according to any one of the preceding aspects, characterized in that the housing cover (1) forms a delivery chamber inlet and a delivery chamber outlet and in that the delivery chamber inlet and the delivery chamber outlet are formed in the end-facing side of the housing cover (1) which axially faces the delivery chamber.

Aspect 11. The pump-motor unit according to any one of the preceding aspects, characterized in that the housing cover (1) is integral.

Aspect 12. The pump-motor unit according to any one of the preceding aspects, characterized in that the housing cover (1) is molded in an original-molding method or a reshaping method or consists of parts which are joined in a material fit.

Aspect 13. The pump-motor unit according to any one of the preceding aspects, characterized in that the intermediate housing structure (12) and the housing cover (1) are components which are formed separately from each other.

Aspect 14. The pump-motor unit according to any one of the preceding aspects, characterized in that the drive motor (20) is arranged between the motor cover (2) and the intermediate housing structure (12) in the axial direction.

Aspect 15. The pump-motor unit according to any one of the preceding aspects, characterized in that the drive motor (20) is an electric motor, for example an electric internal-rotor motor, comprising a rotor (24) and a stator (23), and the rotor (24) is non-rotationally connected to the drive shaft (4), preferably such that it is fixed against shifting in the axial direction.

Aspect 16. The pump-motor unit according to any one of the preceding aspects, characterized in that the delivery member (14) is rotary-driven via the drive shaft (4).

Aspect 17. The pump-motor unit according to any one of the preceding aspects, characterized in that the delivery member (14) is non-rotationally connected to the drive shaft (4), preferably such that it is fixed against shifting in the axial direction.

Aspect 18. The pump-motor unit according to any one of the preceding aspects, characterized in that the delivery member (14) is an externally toothed internal gear (14).

Aspect 19. The pump-motor unit according to any one of the preceding aspects, characterized in that the delivery member (14) is an externally toothed internal gear (14), and the delivery device (10) comprises at least a second delivery member (13), wherein the second delivery member (13) is an internally toothed external gear (13) which surrounds the internal gear (14).

Aspect 20. The pump-motor unit according to any one of the preceding aspects, characterized in that a stator (23) of the drive motor (20) is held axially by the intermediate housing structure (12) and the motor cover (2).

Aspect 21. The pump-motor unit according to the preceding aspect, characterized in that the stator (23) is supported in the axial direction on the intermediate housing structure (12) and the motor cover (2).

Aspect 22. The pump-motor unit according to any one of the preceding aspects, characterized in that a radial gap is formed between a stator (23) of the drive motor (20) and the housing cover (1).

Aspect 23. The pump-motor unit according to the preceding aspect, characterized in that the radial gap surrounds the stator over 360°.

Aspect 24. The pump-motor unit according to any one of the preceding aspects, characterized in that the motor cover (2) seals off the accommodating well (11) of the housing cover (1), preferably in a fluid-proof seal, on the side which faces axially away from the delivery chamber.

Aspect 25. The pump-motor unit according to any one of the preceding aspects, characterized in that the housing cover (1) comprises a housing cover circumferential wall, and the motor cover (2) comprises a motor cover circumferential wall, wherein the housing cover circumferential wall and the motor cover circumferential wall axially overlap each other, and in that at least one gasket (25), preferably a radial gasket, is formed between the motor cover (2) and the housing cover (1), in order to seal off the accommodating well (11) in a fluid-proof seal.

Aspect 26. The pump-motor unit according to the preceding aspect, characterized in that the motor cover (2) protrudes in the axial direction at least partially into the accommodating well (11) of the housing cover (1).

Aspect 27. The pump-motor unit according to any one of the preceding aspects, characterized in that the accommodating well (11) is connected in fluid communication with a suction port (6) of the pump-motor unit via a connecting channel (16) in the region of the drive motor (20), and the connecting channel (16) is formed as a passage through the intermediate housing structure (12).

Aspect 28. The pump-motor unit according to any one of the preceding aspects, characterized in that the accommodating well (11) is connected in fluid communication with a delivery chamber inlet via a connecting channel (16) in the region of the drive motor (20).

Aspect 29. The pump-motor unit according to any one of the preceding aspects, characterized in that a recess groove (17) which encircles a rotational axis of the drive shaft (4) is formed between the intermediate housing structure (12) and the housing cover (1).

Aspect 30. The pump-motor unit according to the preceding aspect, characterized in that the recess groove (17) is formed in the end-facing side of the intermediate housing structure (12) which axially faces the housing cover (1) and/or in the end-facing side of the housing cover (1) which axially faces the intermediate housing structure (12).

Aspect 31. The pump-motor unit according to any one of the preceding aspects, characterized in that a recess groove (17) which encircles a rotational axis of the drive shaft (4) is formed between the intermediate housing structure (12) and the housing cover (1), and in that the recess groove (17) is connected in fluid communication with a suction port (6) of the pump-motor unit.

Aspect 32. The pump-motor unit according to any one of the preceding aspects, characterized in that the housing cover (1) and/or the intermediate housing structure (12) mounts or jointly mount the drive shaft (4).

Aspect 33. The pump-motor unit according to the preceding aspect, characterized in that the housing cover (1) and/or the intermediate housing structure (12) forms or each form a slide bearing for the drive shaft (4).

Aspect 34. The pump-motor unit according to the preceding aspect, characterized in that the housing cover (1) and/or the intermediate housing structure (12) forms or each form a hydrostatic slide bearing for the drive shaft (4).

Aspect 35. The pump-motor unit according to any one of the preceding aspects, characterized in that the pump-motor unit comprises an electronics cover (3) which is arranged on the end-facing side on the side of the motor cover (2) which faces axially away from the drive motor (20), and in that an electronics space formed between the motor cover (2) and the electronics cover (3) is defined in the axial direction by the electronics cover (3) and/or the motor cover (2), and control electronics (32) are formed in the electronics space.

Aspect 36. The pump-motor unit according to the preceding aspect, characterized in that the electronics cover (3) and/or the motor cover (2) surrounds the control electronics (32) on the radially outer side, and in that at least one gasket (35), preferably a radial gasket, is formed between the electronics cover (3) and the motor cover (2), in order to seal off the electronics space in a fluid-proof seal.

Aspect 37. The pump-motor unit according to any one of the preceding aspects, characterized in that the control electronics (32) are formed between the motor cover (2) and the electronics cover (3) in the axial direction.

Aspect 38. The pump-motor unit according to any one of the preceding three aspects, characterized in that the electronics cover (3) surrounds the control electronics (32) on the radially outer side.

Aspect 39. The pump-motor unit according to any one of the preceding four aspects, characterized in that the rear side of the control electronics (32), which lies axially opposite the electronics cover (3), is connected to the electronics cover (3) in a thermally conductive way, preferably by means of a thermally conductive paste.

Aspect 40. The pump-motor unit according to any one of the preceding five aspects, characterized in that the electronics cover (3) comprises cooling elements, in particular cooling fins, for cooling the pump-motor unit.

Aspect 41. The pump-motor unit according to any one of the preceding aspects, characterized in that the motor cover (2) and/or the housing cover (1) are or is manufactured from plastic.

Aspect 42. The pump-motor unit according to any one of the preceding aspects, characterized in that the intermediate housing structure (12) and/or the housing cover (1) are or is manufactured from metal.

Aspect 43. The pump-motor unit according to any one of the preceding aspects, characterized in that the accommodating well (11) is connected in fluid communication with the delivery chamber via a leakage in the region of the drive motor (20).

Aspect 44. The pump-motor unit according to the preceding aspect, characterized in that the leakage is created via a radial gap between the drive shaft (4) and the intermediate housing structure (12).

Aspect 45. The pump-motor unit according to the preceding aspect, characterized in that the leakage simultaneously serves to lubricate a slide bearing of the drive shaft (4), and in that the slide bearing is formed by the intermediate housing structure (12).

The invention is described below on the basis of example embodiments. Features disclosed by the example embodiments advantageously develop the claims and also the embodiments described above.

DETAILED DESCRIPTION OF THE INVENTION

Figure 1:
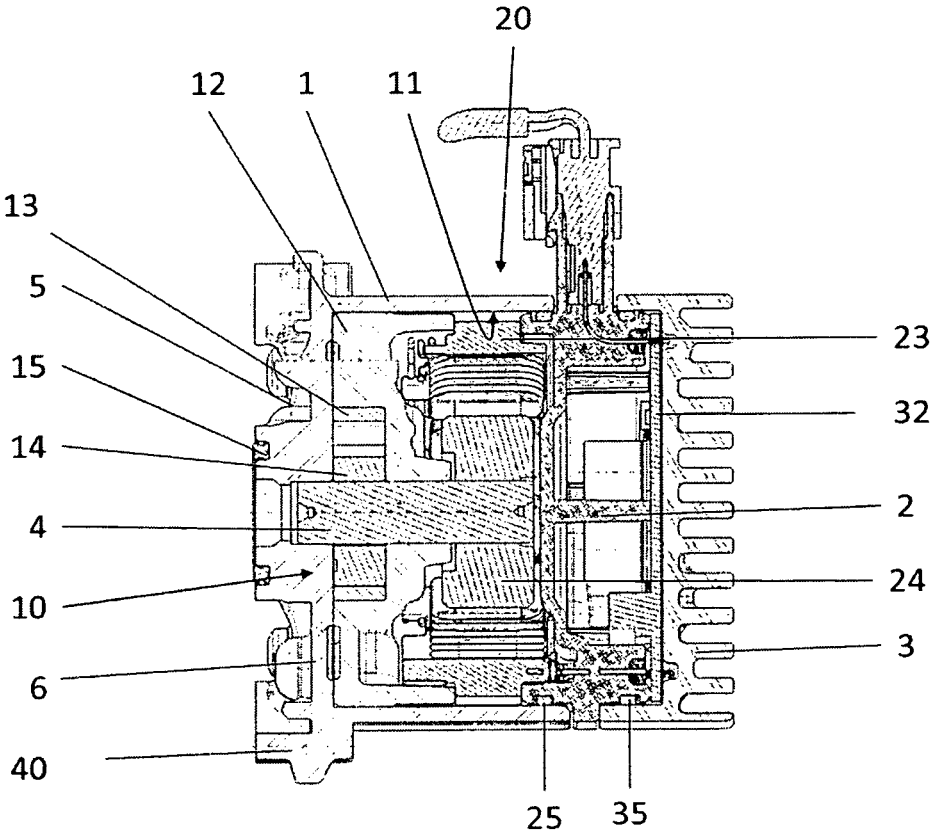
FIG. 1 a cross-section of the pump-motor unit along the drive shaft.
Figure 2:
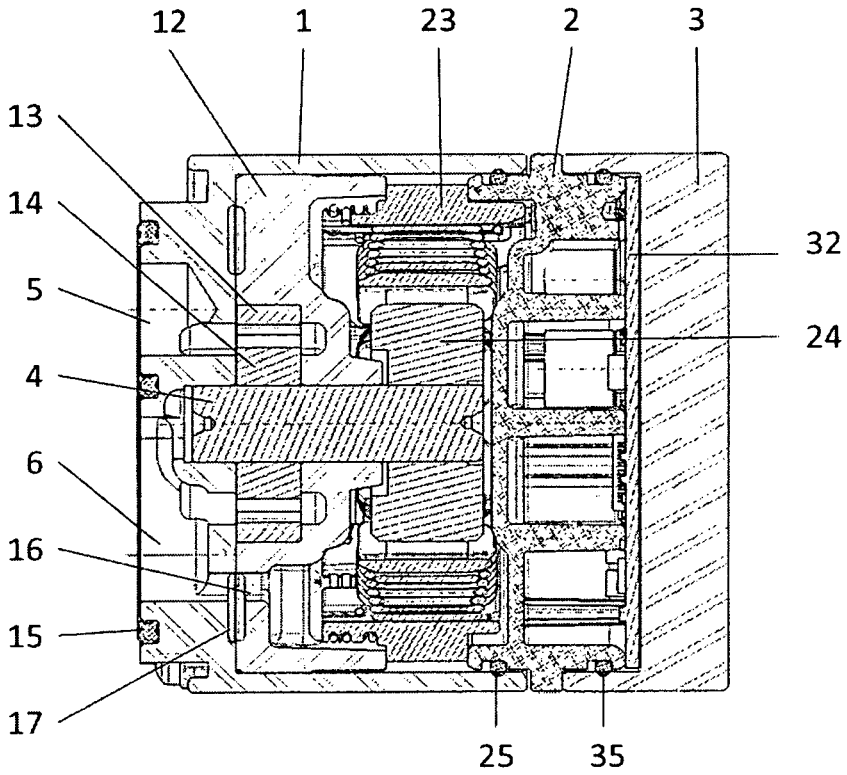
FIG. 2 a cross-section of the pump-motor unit through a second sectional plane.

FIGS. 1 and 2 each show a cross-section through the pump-motor unit along the drive shaft 4, wherein the sectional planes of the two figures are perpendicular to each other. The pump-motor unit comprises a housing featuring a housing cover 1, an intermediate housing structure 12 and a motor cover 2, wherein the housing cover 1 and the intermediate housing structure 12 define a delivery chamber axially on both end-facing sides and circumferentially in the radial direction. The pump-motor unit also comprises: a delivery device 10 featuring a delivery member 13, 14, which can be rotated within the delivery chamber, for delivering a fluid; and a drive motor 20 which is connected to the delivery device 10 via a drive shaft 4. The housing cover 1 and the intermediate housing structure 12 and the housing cover are formed by components which are formed separately from each other.

Figure 3:
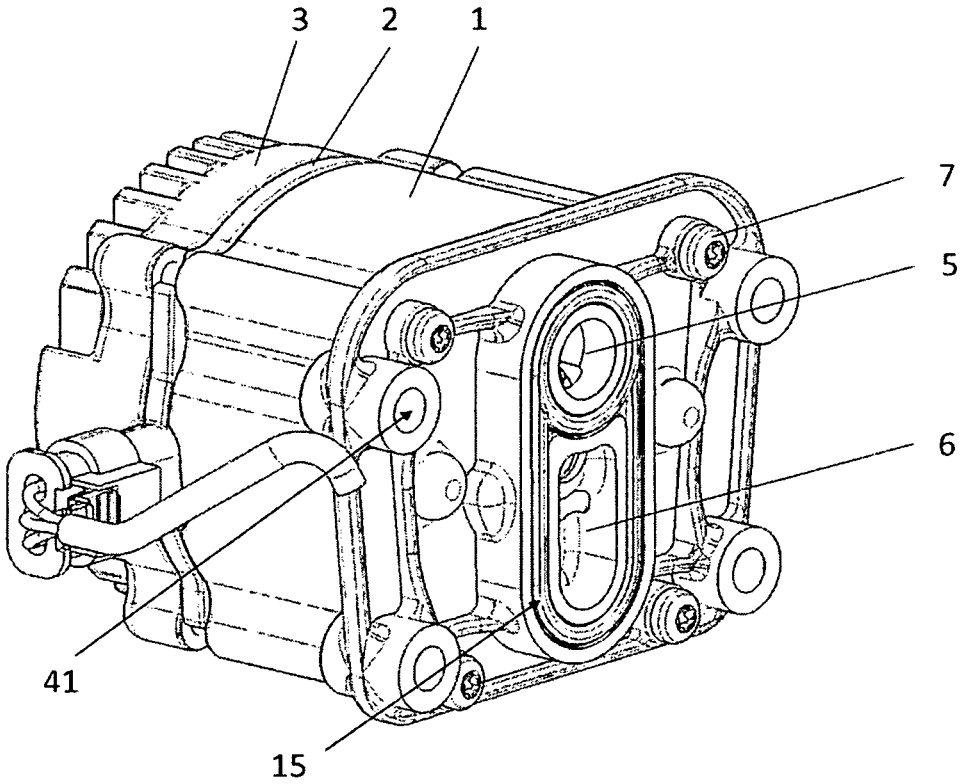
FIG. 3 an isometric view of the pump-motor unit.

As shown in FIG. 1, the pump-motor unit comprises a fitting structure 40 which is formed by the housing cover 1. The fitting structure 40 protrudes radially from the housing cover circumferential wall and, as shown in FIG. 3, comprises passages 41 for fastening elements. When fitted in a fitting well of a gearbox, for example, the pump-motor unit can be fastened by means of the fitting structure 40. The pump-motor unit in accordance with an aspect of the invention is preferably an exterior pump-motor unit which is not designed to be accommodated in a fitting well and can for example be screwed onto a gearbox from the outside. The person skilled in the art will be aware of a multitude of ways of fitting and in particular fastening pump-motor units, such that this will not be discussed in further detail at this juncture. The pump-motor unit in accordance with an aspect of the invention need not then be fastened via fastening elements, but rather could for example also be glued or clamped via the fitting structure.

The housing cover 1 of the housing of the pump-motor unit is integrally formed. The housing cover 1 is preferably molded in an original-molding method or a reshaping method or consists of parts which are joined in a material fit. The housing cover 1 is preferably originally molded from metal. The housing cover 1 of the housing of the pump-motor unit comprises an accommodating well 11 in which the intermediate housing structure 12 is arranged. In this way, the housing cover 1 and in particular the accommodating well 11 of the housing cover 1 encloses the intermediate housing structure 12 on the radially outer side. The intermediate housing structure 12 is supported radially and axially in the accommodating well 11 of the housing cover 1, wherein an end-facing side of the intermediate housing structure 12 which faces the housing cover 1 is supported axially on the base of the accommodating well 11.

In addition to the intermediate housing structure 12, the drive motor 20 is also arranged in the accommodating well 11 of the housing cover 1, such that the accommodating well 11 also encloses the drive motor 20 on the radially outer side. The intermediate housing structure 12 is arranged between the housing cover 1 and the drive motor 20 in the axial direction.

The intermediate housing structure 12 and the housing cover 1 define the delivery chamber axially on both end-facing sides and circumferentially in the radial direction. The intermediate housing structure 12 defines the delivery chamber on a first end-facing side of the delivery chamber and circumferentially in the radial direction, and the housing cover 1 defines the delivery chamber on a second end-facing side. The intermediate housing structure 12 comprises a cavity in which the delivery chamber is formed and which defines the delivery chamber on the end-facing side and circumferentially.

The housing cover 1 forms a pressure port 5 and a suction port 6. Both the pressure port 5 and the suction port 6 are formed in the end-facing side of the housing cover 1 which faces axially away from the delivery chamber. The pressure port 5 is connected in fluid communication with a delivery chamber outlet, and the suction port 6 is connected in fluid communication with a delivery chamber inlet. The delivery chamber outlet and the delivery chamber inlet are formed in the housing cover 1 in the end-facing side of the housing cover 1 which axially faces the delivery chamber, preferably in the form of a pressure pocket and a suction pocket.

A recess groove 17 which encircles a rotational axis of the drive shaft 4 is formed between the intermediate housing structure 12 and the housing cover 1. The recess groove 17 is formed in the end-facing side of the intermediate housing structure 12 which axially faces the housing cover 1 and in the end-facing side of the housing cover 1 which axially faces the intermediate housing structure 12. The recess groove 17 formed in the intermediate housing structure 12 overlaps, preferably completely, in the radial direction with the recess groove 17 formed in the housing cover 1. The recess groove 17 in the intermediate housing structure 12 can extend in the radial direction not as far as or further than the recess groove 17 in the housing cover 1. The recess groove 17 in the intermediate housing structure 12 preferably extends in the radial direction about as far as the recess groove 17 in the housing cover 1. The recess groove 17 is preferably connected in fluid communication with the suction port 6 of the pump-motor unit. In addition to reducing weight, the recess groove 17 serves in particular to reduce cost when machining the end-facing side of the intermediate housing structure 12 which faces the housing cover 1 and the end-facing side of the housing cover 1 which faces the intermediate housing structure 12.

The delivery member 13, 14 is rotatably arranged in the delivery chamber. The delivery member 14 is formed by an externally toothed internal gear which is surrounded by a second delivery member 13 which is formed by an internally toothed gear. The rotational axis of the first delivery member 14 and the rotational axis of the second delivery member 13 extend parallel to each other at a distance. The delivery member 14 and the second delivery member 13, in particular the teeth of the externally toothed delivery member 4 and the teeth of the internally toothed second delivery member 13, are in engagement such that a rotation of the delivery member 14 is transmitted onto the second delivery member 13. Delivery cells are formed between the engaging teeth of the delivery member 14 and the second delivery member 13, which change their volume in the circumferential direction, such that fluid can be delivered from a low-pressure side of the pump to a high-pressure side of the pump. Internal gear pumps of this type are known to the person skilled in the art, for which reason a detailed description shall be omitted here. An aspect of the invention is not explicitly limited to internal gear pumps, and vane cell pumps or external gear pumps can for example also be used.

The delivery member 14 is non-rotationally connected to the drive shaft 4 and can also be connected to the drive shaft 4 such that it is fixed against shifting in the axial direction. Preferably, the delivery member 14 is non-rotationally connected to the drive shaft 4 and can be shifted on the drive shaft 4 in the axial direction. The delivery member 14 is rotary-driven by the drive shaft 4. The drive shaft 4 protrudes through both the delivery member 14 and the second delivery member 13 in the axial direction and protrudes from both the delivery member 14 and the second delivery member 13 on both sides in the axial direction.

The drive shaft 4 is mounted by the housing cover 1 and the intermediate housing structure 12, wherein the delivery member 14 is arranged between the bearing point of the housing cover 1 and the bearing point of the intermediate housing structure 12. The housing cover 1 and the intermediate housing structure 12 each form a slide bearing for the drive shaft 4.

The slide bearing of the intermediate housing structure 12 is connected in fluid communication with the delivery chamber via a leakage. The leakage is preferably created via a radial gap between the drive shaft 4 and the intermediate housing structure 12 in the region of the bearing point of the intermediate housing structure 12 for the drive shaft 4. The radial gap can surround the drive shaft 4 in the circumferential direction over a certain angle or over 360°. The slide bearing of the intermediate housing structure 12 is preferably connected in fluid communication with the high-pressure side of the delivery chamber, such that pressure fluid passes from the delivery chamber into the slide bearing of the intermediate housing structure 12. In preferred embodiments, the slide bearing of the housing cover 1 is also connected in fluid communication with the delivery chamber, particularly preferably with the high-pressure side of the delivery chamber.

The drive motor 20 of the pump-motor unit is an electric motor, in particular an electric internal-rotor motor, comprising a rotor 24 and a stator 23, wherein the rotor 24 is non-rotationally connected to the drive shaft 4, preferably such that it is fixed against shifting in the axial direction. The drive motor 20 is arranged in the accommodating well 11 of the housing cover 1. The stator 23 of the drive motor 20 is held axially by the intermediate housing structure 12 and the motor cover 2. A radial gap which is formed between the stator 23 and the housing cover 1 surrounds the stator over 360°.

The motor cover 2 seals off the accommodating well 11 of the housing cover 1, in a fluid-proof seal, on the side which faces axially away from the delivery chamber. To this end, the housing cover 1 comprises a housing cover circumferential wall, and the motor cover 2 comprises a motor cover circumferential wall, wherein the housing cover circumferential wall and the motor cover circumferential wall axially overlap each other and at least one gasket 25 is formed between the motor cover 2 and the housing cover 1. The motor cover 2 protrudes in the axial direction at least partially into the accommodating well 11 of the housing cover 1, such that the housing cover circumferential wall at least partially encloses the motor cover circumferential wall on the outside in the axial direction.

The drive motor 20 is preferably a wet-running electric motor. To this end, the accommodating well 11 of the housing cover 1 is connected in fluid communication with the delivery chamber in the region of the drive motor 20. The accommodating well 11 of the housing cover 1 is preferably connected in fluid communication with the high-pressure side of the delivery chamber in the region of the drive motor 20, in particular via the slide bearing of the intermediate housing structure 12.

In order that the fluid can flow off from the accommodating well 11 in the region of the drive motor 20, the accommodating well 11 is connected in fluid communication with the suction port 6 of the pump-motor unit via a connecting channel 16 in the region of the drive motor 20. The connecting channel 16 is formed as a passage through the intermediate housing structure 12. The accommodating well 11 is thus also connected in fluid communication with the delivery chamber inlet in the region of the drive motor 20. In this way, fluid which is situated in the region of the drive motor 20 can flow off from the accommodating well 11 via the connecting channel 16. Fluid from the delivery chamber thus continuously flows around and cools the drive motor 20.

The pump-motor unit also comprises an electronics cover 3 which is arranged on the end-facing side on the side of the motor cover 2 which faces axially away from the drive motor 20. An electronics space formed between the motor cover 2 and the electronics cover 3 is defined in the axial direction and in the circumferential direction by the electronics cover 3 and the motor cover 2, wherein the electronics cover 3 defines the electronics space circumferentially and on the end-facing side which faces axially away from the drive motor 20. The motor cover 2 defines the electronics space on the end-facing side which axially faces the drive motor 20.

The motor cover 2 seals off the electronics space, in a fluid-proof seal, on the end-facing side on the side which axially faces the drive motor 20. To this end, the motor cover circumferential wall overlaps in the axial direction with an electronics cover circumferential wall, wherein a gasket 35 is formed between the motor cover circumferential wall and the electronics cover circumferential wall. The gasket 35 is formed as a radial gasket. The motor cover 2 protrudes axially into a cavity in the electronics cover 3, such that the motor cover circumferential wall is enclosed on the radially outer side by the electronics cover circumferential wall.

The electronics cover 3 comprises cooling elements, in particular cooling fins, for cooling the pump-motor unit on the end-facing side which faces axially away from the drive motor 20. The cooling fins are preferably formed from metal. The electronics cover 3 and the cooling elements can be integrally formed together, for example molded in an original-molding method or a reshaping method, or can consist of parts which are joined in a material fit, for example by means of sintering. It is however also possible to join the cooling elements to the electronics cover 3 in a subsequent manufacturing step. The electronics cover 3 can then for example be formed from a different material to the cooling fins. Preferably, the electronics cover 3 and the cooling fins comprise the same material.

Control electronics 32 are formed in the electronics space. The control electronics 32 serve to control the drive motor 20. The control electronics 32 are surrounded on the radially outer side by the electronics cover 3. The rear side of the control electronics 32, which lies axially opposite the electronics cover 3, is connected to the electronics cover 3 in a thermally conductive way. The control electronics 32 are preferably connected to the electronics cover 3 in a thermally conductive way by means of a thermally conductive paste.

The housing cover 1 and/or the intermediate housing structure 12 are preferably manufactured from metal, but can for example also be manufactured from plastic. The motor cover 2 in particular is preferably manufactured from plastic, but can for example also be manufactured from metal.

FIG. 3 shows an isometric view of the pump-motor unit. The housing of the pump-motor unit is held together by means of holding elements 7, wherein the holding elements 7 are preferably formed by screws. The holding elements 7 protrude through the housing cover 1 and/or the electronics cover 3, wherein the motor cover 2 is held axially between the housing cover 1 and the electronics cover 3. The holding elements 7 can also protrude through the motor cover 2. Alternatively, the motor cover 2 can also be clamped exclusively between the housing cover 1 and the electronics cover 3.

FIG. 3 also shows how the suction port 6 and the pressure port 5 are each surrounded by a gasket, wherein the gasket of the suction port 6 surrounds both the pressure port 5 and the suction port 6 radially. The gasket of the pressure port 5 serves to seal off the pressure port 5 from the suction port 6, while the gasket of the suction port 6 serves to seal it off from the outside. The two gaskets can be formed together or as individual gaskets.

REFERENCE SIGNS

1 housing cover
2 motor cover
3 electronics cover
4 drive shaft
5 pressure port
6 suction port
7 holding element
10 delivery device
11 accommodating well
12 intermediate housing structure
13 second delivery member
14 delivery member

15 gasket
16 connecting channel
17 recess groove
20 drive motor
23 stator
24 rotor
25 gasket
32 control electronics
35 gasket
40 fitting structure
41 passages

The invention claimed is:

1. An exterior pump-motor unit for delivering a liquid, the pump-motor unit comprising:

a housing comprising an integrally formed housing cover, an integrally formed intermediate housing structure and a motor cover, wherein the housing cover and the intermediate housing structure define a delivery chamber axially on both end-facing sides and circumferentially in the radial direction;

a delivery device featuring a delivery member, which can be rotated within the delivery chamber, for delivering the liquid;

and a drive motor which is connected to the delivery device via a drive shaft, wherein the housing cover forms an accommodating well, a delivery chamber inlet and a delivery chamber outlet, a pressure port and a suction port, and the drive motor and the intermediate housing structure are arranged in the accommodating well, and, wherein the intermediate housing structure comprises a cavity in the end-facing side which faces the housing cover, wherein the base of said cavity defines the delivery chamber on the end-facing side which is opposite the housing cover, and the circumferential wall of said cavity circumferentially encloses the delivery chamber, wherein the housing cover seals off the delivery chamber on the end-facing side on a side which faces axially away from the motor cover, wherein the delivery chamber inlet and the delivery chamber outlet are formed in the end-facing side of the housing cover which axially faces the delivery chamber, and wherein the pressure port and the suction port are formed in the end-facing side of the housing cover which faces axially away from the delivery chamber, wherein the suction port and the pressure port are surrounded radially by a gasket, wherein the pump-motor unit comprises a fitting structure by means of which the pump-motor unit is connectable to a consumer and wherein the fitting structure protrudes on a radially outer side, from the housing cover, wherein the fitting structure comprises passages through which fastening elements can protrude in order to form a holding engagement with bores or cavities provided on the consumer, and wherein the passages extend in the axial direction and when the pump-motor unit is connected to the consumer by means of the fastening elements, the pump-motor unit is pressed into sealing contact with the consumer.

2. The pump-motor unit according to claim 1, wherein the drive motor is arranged between the motor cover and the intermediate housing structure in the axial direction.

3. The pump-motor unit according to claim 1, wherein the drive motor is an electric motor comprising a rotor and a stator, and the rotor is non-rotationally connected to the drive shaft.

4. The pump-motor unit according to claim 3, wherein the drive motor is an electric internal-rotor motor.

5. The pump-motor unit according to claim 3, wherein the rotor is non-rotationally connected to the drive shaft such that it is fixed against shifting in the axial direction.

6. The pump-motor unit according to claim 1, wherein the delivery member is non-rotationally connected to the drive shaft.

7. The pump-motor unit according to claim 6, wherein the delivery member is non-rotationally connected to the drive shaft such that it is fixed against shifting in the axial direction.

8. The pump-motor unit according to claim 1, wherein a stator of the drive motor is held axially by the intermediate housing structure and the motor cover.

9. The pump-motor unit according to claim 1, wherein a radial gap is formed between a stator of the drive motor and the housing cover.

10. The pump-motor unit according to claim 1, wherein the motor cover seals off the accommodating well of the housing cover on the side which faces axially away from the delivery chamber.

11. The pump-motor unit according to claim 10, wherein the motor cover seals off the accommodating well of the housing cover in a fluid-proof seal, on the side which faces axially away from the delivery chamber.

12. The pump-motor unit according to claim 1, wherein the housing cover comprises a housing cover circumferential wall, and the motor cover comprises a motor cover circumferential wall, wherein the housing cover circumferential wall and the motor cover circumferential wall axially overlap each other, and wherein at least one gasket is formed between the motor cover and the housing cover, in order to seal off the accommodating well in a fluid-proof seal.

13. The pump-motor unit according to claim 12, wherein the at least one gasket is a radial gasket.

14. The pump-motor unit according to claim 1, wherein the motor cover protrudes in the axial direction at least partially into the accommodating well of the housing cover.

15. The pump-motor unit according to claim 1, wherein the accommodating well is connected in fluid communication with a suction port of the pump-motor unit via a connecting channel in the region of the drive motor, and the connecting channel is formed as a passage through the intermediate housing structure.

16. The pump-motor unit according to claim 1, wherein the housing cover and/or the intermediate housing structure mounts or jointly mount the drive shaft.

17. The pump-motor unit according to claim 1, wherein the pump-motor unit comprises an electronics cover which is arranged on the end-facing side on the side of the motor cover which faces axially away from the drive motor, and wherein an electronics space formed between the motor cover and the electronics cover is defined in the axial direction by the electronics cover and/or the motor cover, and control electronics are formed in the electronics space.

18. The pump-motor unit according to claim 17, wherein the electronics cover and/or the motor cover surrounds the control electronics on the radially outer side, and wherein at least one gasket is formed between the electronics cover and the motor cover, in order to seal off the electronics space in a fluid-proof seal.

19. The pump-motor unit according to claim 18, wherein the at least one gasket is a radial gasket.

20. The pump-motor unit according to claim 17, wherein the electronics cover comprises cooling fins for cooling the pump-motor unit.

21. The pump-motor unit according to claim 1, wherein the intermediate housing structure is supported radially and/or axially in the accommodating well of the housing cover.

22. The pump-motor unit according to claim 1, wherein an end-facing side of the intermediate housing structure which axially faces the housing cover, and an end-facing side of the housing cover which axially faces the intermediate housing structure, are in direct contact.

23. The pump-motor unit according to claim 1, wherein the intermediate housing structure is arranged between the housing cover and the drive motor in the axial direction.

24. The pump-motor unit according to claim 1, wherein the housing cover and/or the intermediate housing structure and/or the motor cover are manufactured from metal or plastic.

25. The pump-motor unit according to claim 1, wherein the housing of the pump-motor unit is held together by means of at least one holding element.

* * * * *